US007434317B2

(12) United States Patent
Levine et al.

(10) Patent No.: US 7,434,317 B2
(45) Date of Patent: Oct. 14, 2008

(54) SLIDE ASSEMBLY DEVICE FOR A SNAP-OFF BLADE UTILITY KNIFE

(75) Inventors: Steven R. Levine, Mooreville, NC (US); Gordon Anderson, Esslingen (DE); Norman Leblanc, Davidson, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 386 days.

(21) Appl. No.: 10/947,741

(22) Filed: Sep. 23, 2004

(65) Prior Publication Data

US 2006/0059695 A1 Mar. 23, 2006

(51) Int. Cl.
*B26B 3/06* (2006.01)

(52) U.S. Cl. ..... 30/162; 30/335

(58) Field of Classification Search ..... 30/162, 30/335, 2

See application file for complete search history.

(56) References Cited

U.S. PATENT DOCUMENTS

| | | | | |
|---|---|---|---|---|
| 3,192,624 | A | 7/1965 | Gringer | |
| 3,708,881 | A | 1/1973 | Bennett | |
| 4,170,062 | A | 10/1979 | Machida | |
| 4,277,888 | A | 7/1981 | Szabo | |
| 4,322,885 | A | 4/1982 | Osada | |
| 4,621,425 | A | 11/1986 | Stoutenberg | |
| 4,628,717 | A | 12/1986 | Blum | |
| 4,794,693 | A | 1/1989 | Mayama et al. | |
| 4,930,218 | A | 6/1990 | Jacoff | |
| 5,012,581 | A | 5/1991 | Fletcher et al. | |
| 5,269,063 | A | 12/1993 | Okada | |
| 5,502,896 | A | 4/1996 | Chen | |
| 6,000,136 | A | 12/1999 | Owens | |
| 6,161,290 | A | 12/2000 | Takamasa | |
| 6,226,873 | B1 | 5/2001 | Okumura | |
| 6,249,975 | B1 | 6/2001 | Lin | |
| 6,487,778 | B1 | 12/2002 | Gringer et al. | |
| 6,513,246 | B2 | 2/2003 | Ping | |
| 6,966,113 | B2 * | 11/2005 | Fossella | 30/162 |
| 2002/0056198 | A1 | 5/2002 | Ping | |

FOREIGN PATENT DOCUMENTS

| | | |
|---|---|---|
| GB | 2039814 | 8/1980 |
| GB | 1575285 | 9/1980 |
| GB | 2 206 832 | 3/1991 |
| GB | 2319204 | 5/1998 |
| WO | 03009975 A2 | 2/2003 |

OTHER PUBLICATIONS

UK Search Report, dated Oct. 19, 2007.
Combined Search and Examination Report under Sections 17 and 18(3), GB Patent Application No. 0717352.9, dated Jan. 21, 2008.

* cited by examiner

*Primary Examiner*—Kenneth E. Peterson
*Assistant Examiner*—Sean Michalski
(74) *Attorney, Agent, or Firm*—Dennis J. Williamson; Moore & VanAllen PLLC

(57) ABSTRACT

A utility knife includes a body having a groove adapted to receive a blade. The groove has a plurality of tabs defined on at least a first side. The utility knife also includes a slide assembly device positioned in the body for sliding movement with respect to the body. The slide assembly device includes a housing with a first engaging member having a first protrusion and a second engaging member having a second protrusion releasably engaged with the tabs. The slide assembly device also includes a rocker attached to the housing that is operatively connected to at least one of the engaging members. The rocker is operable for disengaging the first protrusion or second protrusion with respect to the tabs. Disengaging one of the first and second protrusions by the rocker allows sliding movement of the slide assembly device with respect to the body.

29 Claims, 14 Drawing Sheets

144
42
118
142

SLIDE ASSEMBLY DEVICE FOR A SNAP-OFF BLADE UTILITY KNIFE

TECHNICAL FIELD

This invention relates generally to hand-held cutting tools. More particularly, this invention relates to snap-off blade utility knives having slide assembly devices.

BACKGROUND OF THE INVENTION

Utility knives are hand-held cutting tools capable of a wide range of uses. Typically, a utility knife includes a longitudinal main frame to house either a completely interchangeable blade or a snap-off blade and includes a sliding mechanism attached to the blade. The sliding mechanism moves the blade between an extended position and a retracted position relative to the main frame. The sliding mechanism of the utility knife often includes a resilient engaging member, such as a spring, which engages with a set of tabs formed longitudinally in regular intervals in a groove defined in the main frame that locks the sliding mechanism at a fixed position. A panel located on the sliding mechanism enables a user to slide the sliding mechanism, which carries the blade, to the extended position and the retracted position. Commonly, the blade is a snap-off blade, which has a series of fracture lines and can be broken transversely to expose a new sharp edge portion. Extra blades can be stored in a compartment within the main frame of the utility knife.

In most of the existing devices, the only safety feature provided to hold the blade at the fixed position is the engagement between the resilient engaging member formed on the sliding mechanism and the tabs formed in the groove. Sliding the blade in such a device can be difficult, due to the high friction created between the tabs and the engaging member. Moreover, replacing a new snap-off blade in such a device requires first dissembling and then reassembling substantially the entire utility knife, which is inconvenient to the user.

What is needed is a snap-off blade utility knife having a slide assembly device that can securely lock the blade in position during use, and can be easily slid to a desired extended position for use and to a desired retracted position for storage. It is also desirable to have a snap-off blade utility knife that allows convenient blade replacement.

SUMMARY OF THE INVENTION

The foregoing problems are solved in a snap-off blade utility knife having a slide assembly device in accordance with the present invention.

One aspect of the present invention regards a utility knife that includes a body having a groove adapted to receive a blade. The groove has a plurality of tabs defined on at least a first side. The utility knife also includes a slide assembly device positioned in the body for sliding movement with respect to the body. The slide assembly device includes a housing with a first engaging member having a first protrusion and a second engaging member having a second protrusion releasably engaged with the tabs. The slide assembly device also includes a rocker attached to the housing that is operatively connected to at least one of the engaging members. The rocker is operable for disengaging the first protrusion or second protrusion with respect to the tabs. Disengaging one of the first and second protrusions by the rocker allows sliding movement of the slide assembly device with respect to the body.

Another aspect of the present invention regards a blade guide assembly that includes a longitudinally extending shell. The longitudinally extending shell is configured to fit within the groove of the utility knife and adapted to house at least one blade. The blade guide assembly also includes a substantially flat panel having a blade hole detent tang. The substantially flat panel is configured to fit within the longitudinally extending shell. The blade guide assembly further includes a spring balanced on the longitudinally extending shell. The spring is configured to bias the substantially flat panel towards the blade. The blade hole detent tang is configured to be inserted within a hole of the blade.

A further aspect of the present invention regards sliding the blade in the utility knife. First, slide the slide assembly device relative to the body of the utility knife. A boss of the slide assembly device is removably connected to the blade. Second, discontinue sliding the slide assembly device.

Another aspect of the present invention regards replacing the blade in the utility knife. First, slide the slide assembly device relative to the body of the utility knife to a first end. Second, dispatch the blade. Last, slide the slide assembly device relative to the body of the utility knife to a second end such that the boss of the slide assembly device overlaps the blade hole detent tang of the blade guide assembly.

DETAILED DESCRIPTION

Figure 1:
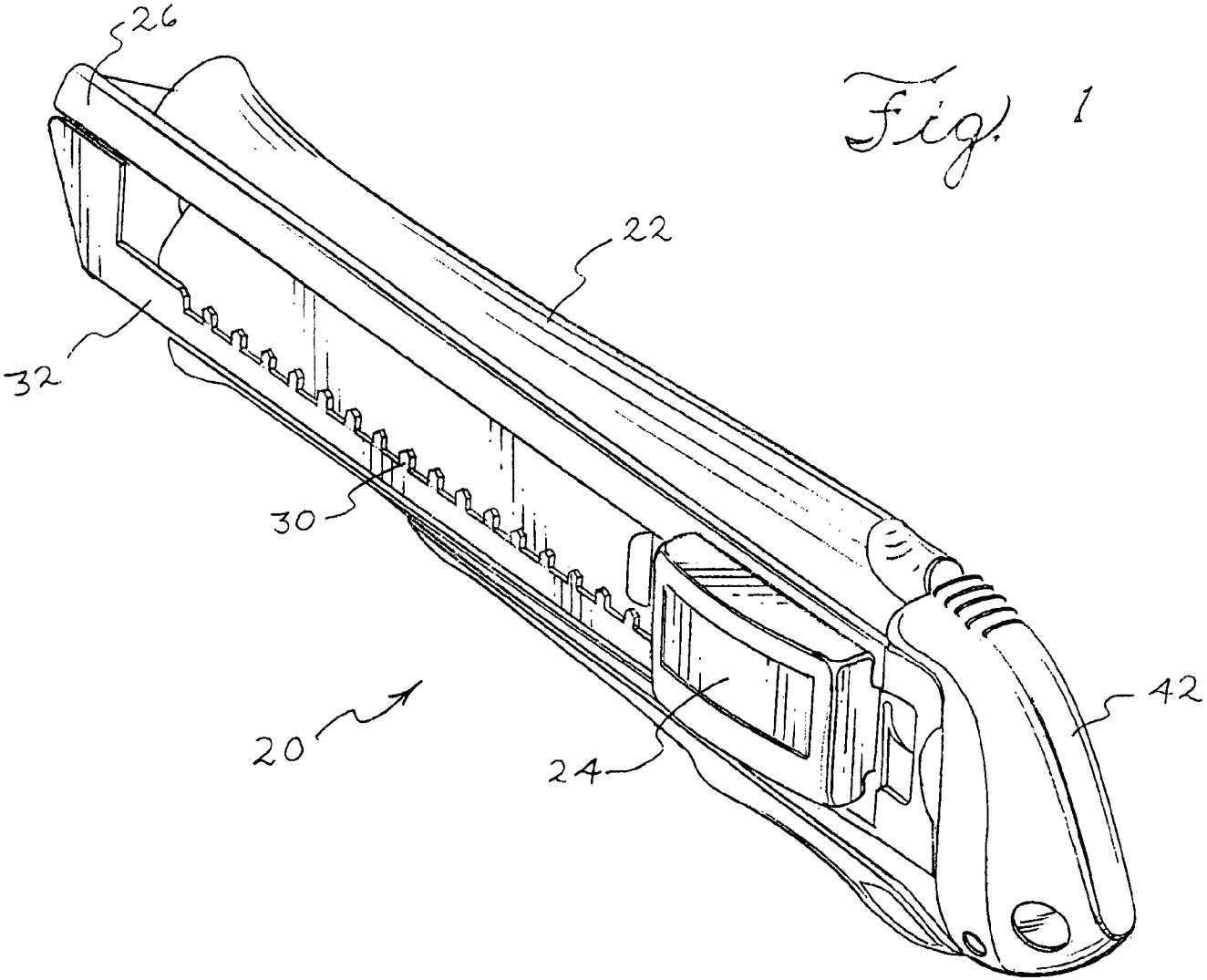
FIG. 1 depicts a perspective view of an embodiment of a utility knife in accordance with the present invention.

A better understanding of the present invention will now be had upon reference to the following detailed description, when read in conjunction with the accompanying drawings, wherein like reference characters refer to like parts throughout the several views of the present invention.

Figure 2:
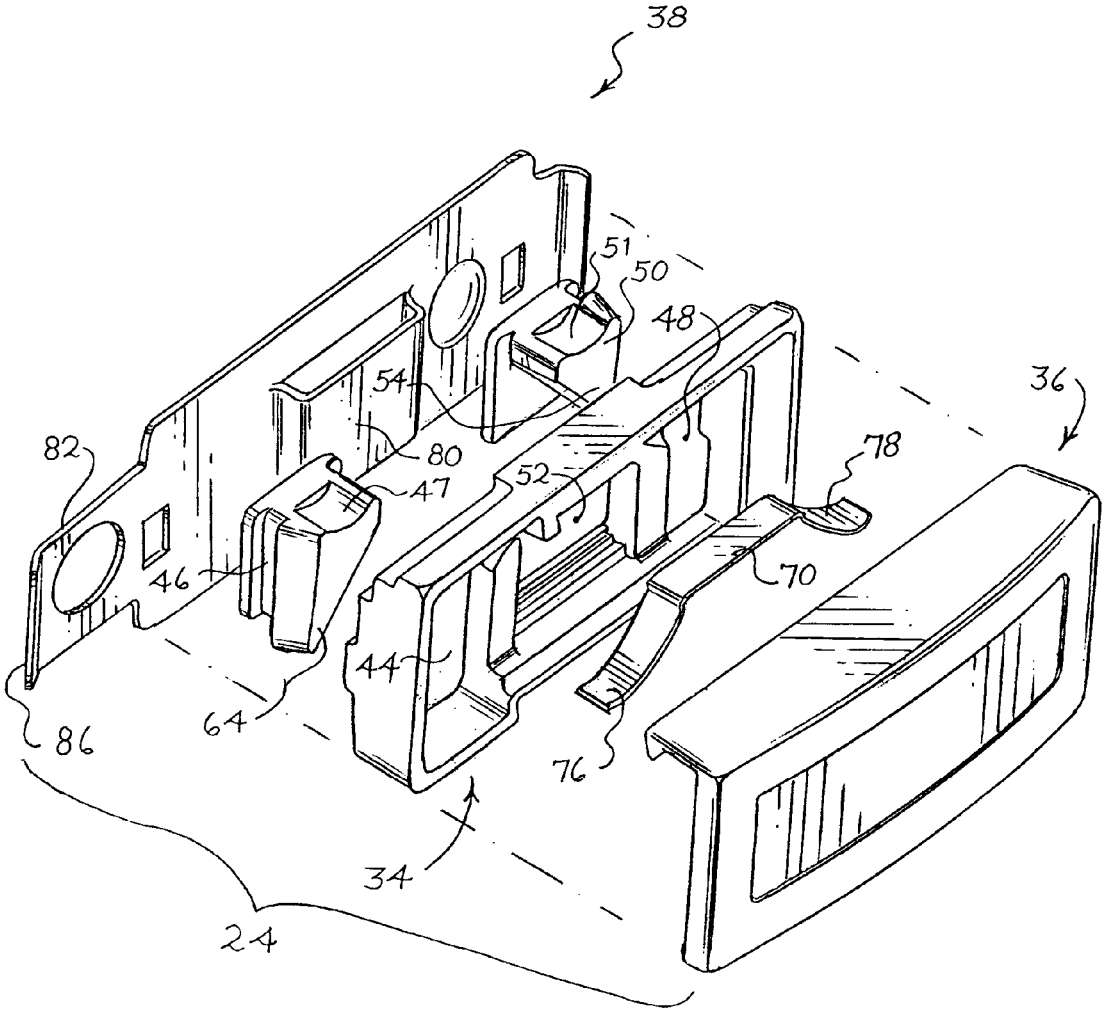
FIG. 2 depicts an exploded perspective view of an embodiment of a slide assembly device to be used with the utility knife of FIG. 1 in accordance with the present invention.
Figure 14:
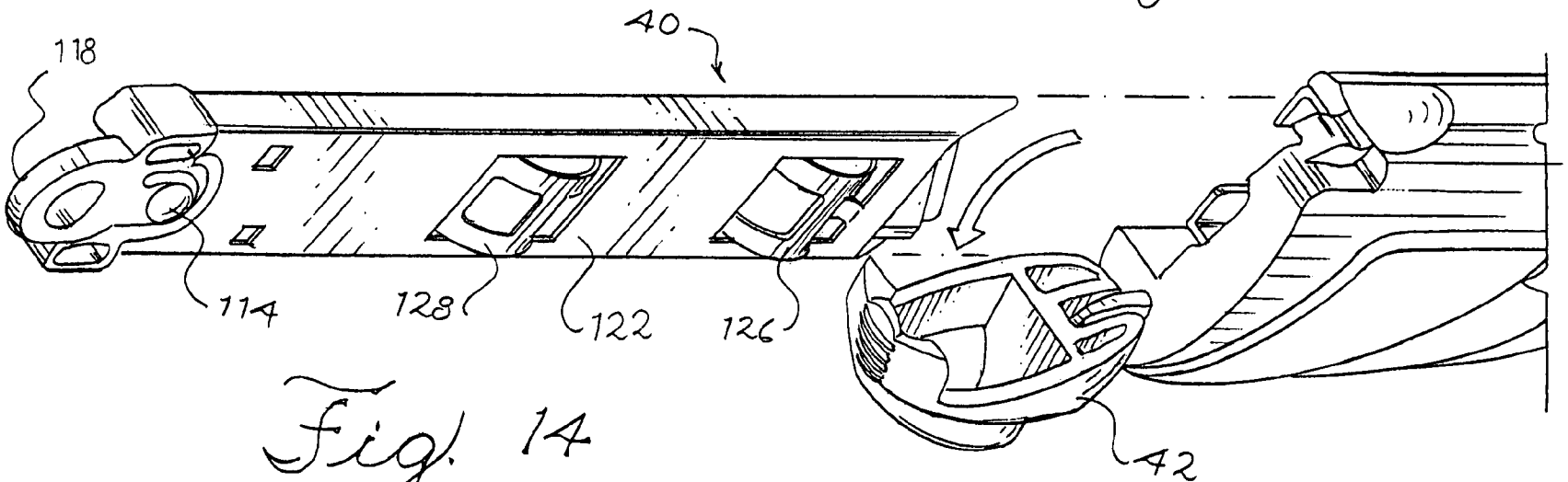
FIG. 14 depicts a back perspective view of the blade guide assembly of FIG. 13 to be used with the utility knife of FIG. 1.

A utility knife 20 according to an embodiment of the present invention, as shown in FIG. 1, includes a body 22 and a slide assembly device 24. The body 22 has a groove 26 adapted to receive a blade 28 (not shown). The groove 26 has a plurality of tabs 30 on at least a first side 32. The slide assembly device 24 is positioned in the body 22 for sliding movement with respect to the body 22. The slide assembly device 24 preferably includes a housing 34, a rocker 36 and a ski 38, as depicted in FIG. 2. The utility knife 20 preferably also includes a blade guide assembly 40 and an end cap 42, as depicted in FIG. 14.

The housing 34 of the slide assembly device 24 includes a slot 44 for receiving an engaging member 46 and a slot 48 for receiving an engaging member 50, as depicted in FIG. 2. The housing 34 may further include a slot 52 between slots 44 and 48. The slot 52 may be used to attach to the ski 38 by receiving and mating in a snap-fit relationship with a substantially rectangular protruded surface 80 of the ski 38.

Figure 6:
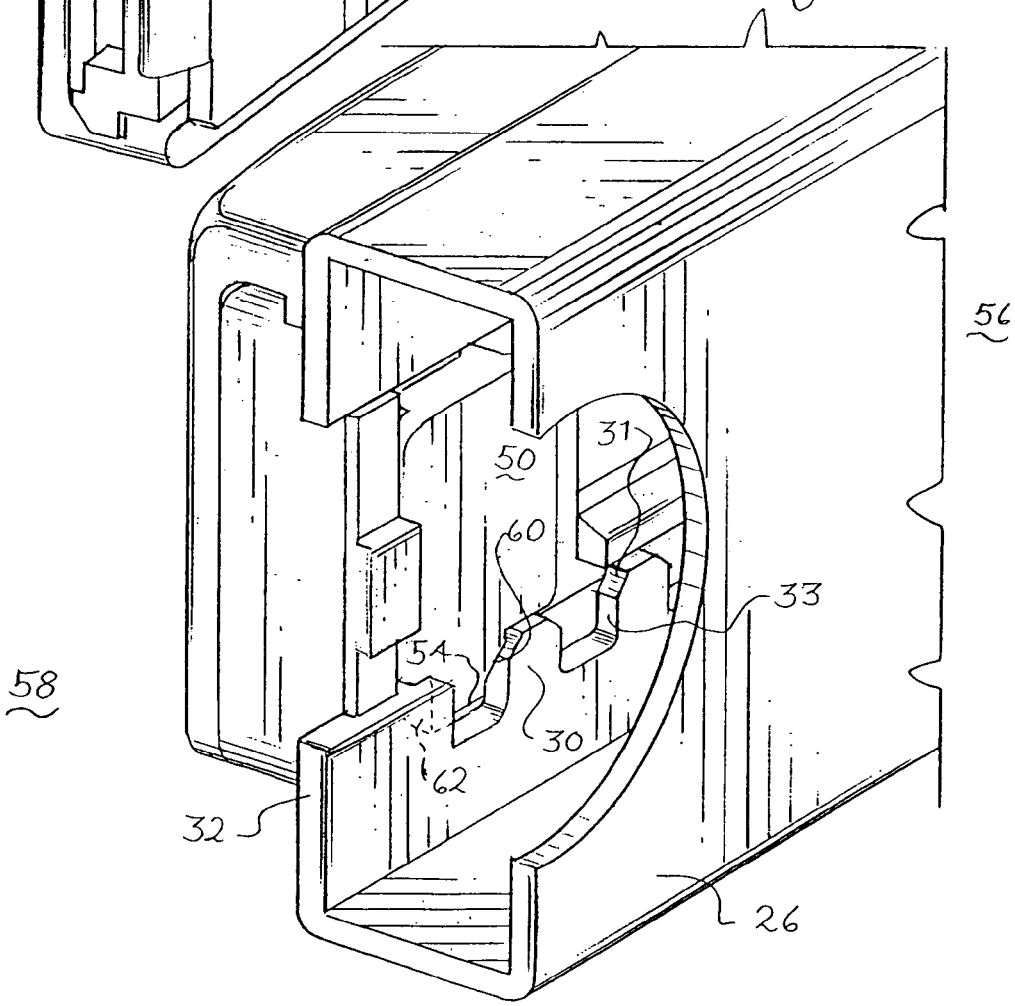
FIG. 6 depicts a perspective view of an embodiment of an engaging member of the slide assembly device of FIG. 2.

The engaging member 50 includes a protrusion 54 releasably engaged with the tabs 30 on the first side 32 of the groove 26, as depicted in FIG. 6. Preferably, the protrusion 54 has a substantially slanted side 60 facing one end 56 of the utility knife 20. Preferably, the protrusion 54 also has a straight side 62 facing an opposite end 58 of the utility knife 20. The substantially slanted side 60 of the protrusion 54 is configured to slide the slide assembly device 24 towards the end 56 of the utility knife 20 by moving along the matching slanted portions 31 located on one side of the tabs 30, which produces a ratcheting sound. The straight side 62 of the protrusion 54 is configured on an opposite side of the tabs 30 to prevent the slide assembly device 24 from sliding towards the end 58 of the utility knife by matching with one of the straight portions 33 of the tabs 30. Thus, the straight side 62 is useful to fix the slide assembly device 24 in an idle or released configuration.

Figure 7A:
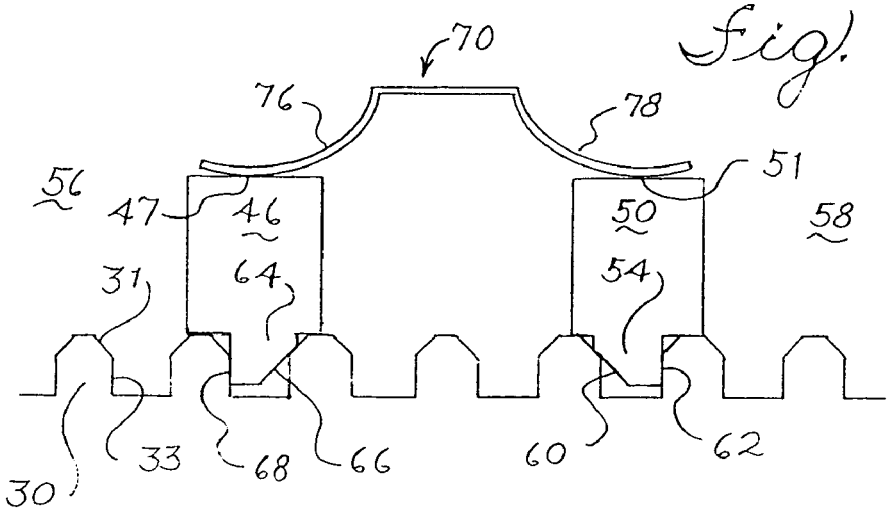
FIG. 7A depicts a partial front view of the engaging members of the slide assembly device of FIG. 3 engaging with the tabs.

The engaging member 46 includes a protrusion 64 releasably engaged with the tabs 30 on the first side 32 of the groove 26, as depicted in FIG. 7A. Preferably, the protrusion 64 is similar to protrusion 54 in that it has a substantially slanted side 66 facing the end 58 of the utility knife 20 and a straight side 68 facing the end 56 of the utility knife 20. The substantially slanted side 66 is configured on one side of the protrusion 64 to slide the slide assembly device 24 towards the end 58 of the utility knife 20 by moving along the matching slanted portions 31 of the tabs 30, which produces a ratcheting sound. The straight side 68 is configured on an opposite side of the protrusion 64 to prevent the slide assembly device 24 from sliding towards the end 56 of the utility knife by matching with one of the straight portions 33 of the tabs 30. Thus, the straight side 68, like straight side 62, is useful to fix the slide assembly device 24 in an idle or released configuration.

Figure 3:
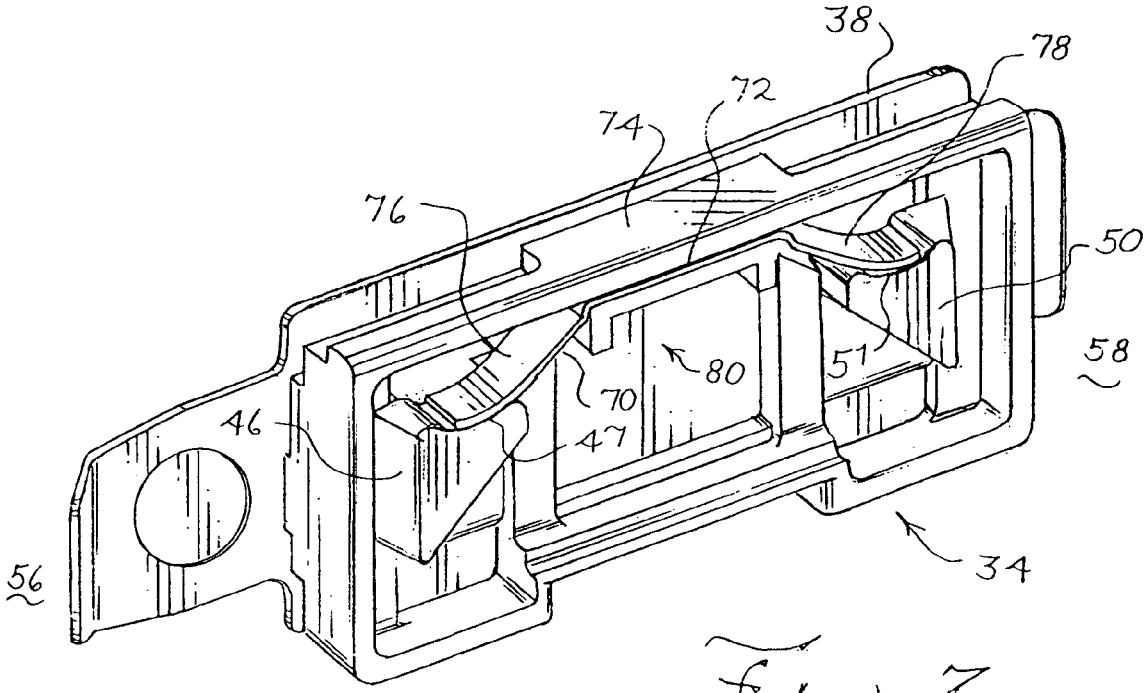
FIG. 3 depicts an assembled view of the slide assembly device of FIG. 2.
Figure 4:
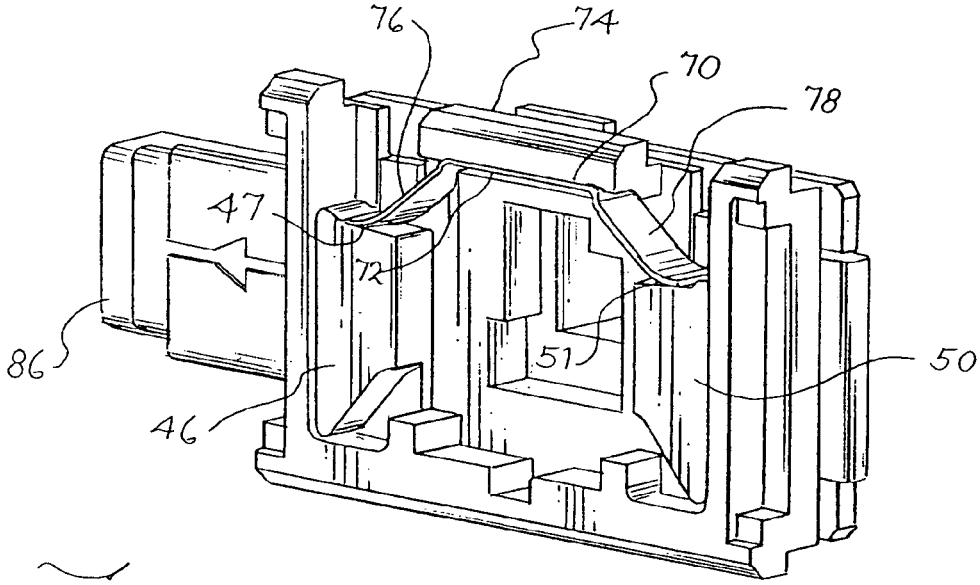
FIG. 4 depicts a perspective view of another embodiment of a slide assembly device to be used with the utility knife of FIG. 1 in accordance with the present invention.

The slide assembly device 24 also includes a spring 70, as depicted in FIGS. 2, 3, 4 and 7A. The spring 70 includes a substantially flat portion 72 configured to be sandwiched to the housing 34 near a central portion 74 of the housing 34, as depicted in FIGS. 3 and 4. The spring 70 also includes an extended portion 76 that selectively contacts a top portion 47 of the engaging member 46 so as to bias the engaging member 46 downward so that the engaging member 46 assumes an idle or released configuration, as depicted in FIG. 7A. Similarly, the spring 70 includes an extended portion 78 that selectively contacts a top portion 51 of the engaging member 50 so as to bias the engaging member 50 downward so that the engaging member 50 assumes an idle or released configuration. In the idle or released configuration, the spring 70 biases either the engaging members 46 or 50 towards the tabs 30 so that the corresponding protrusions 54 and 64 enter spaces between to adjacent tabs 30 and engage with the adjacent tabs 30 of the groove 26. It is noted that the spring 70 of the present may be a compressed spring, a tension spring, or any other springs or plastic flaps that are known in the art.

Figure 5:
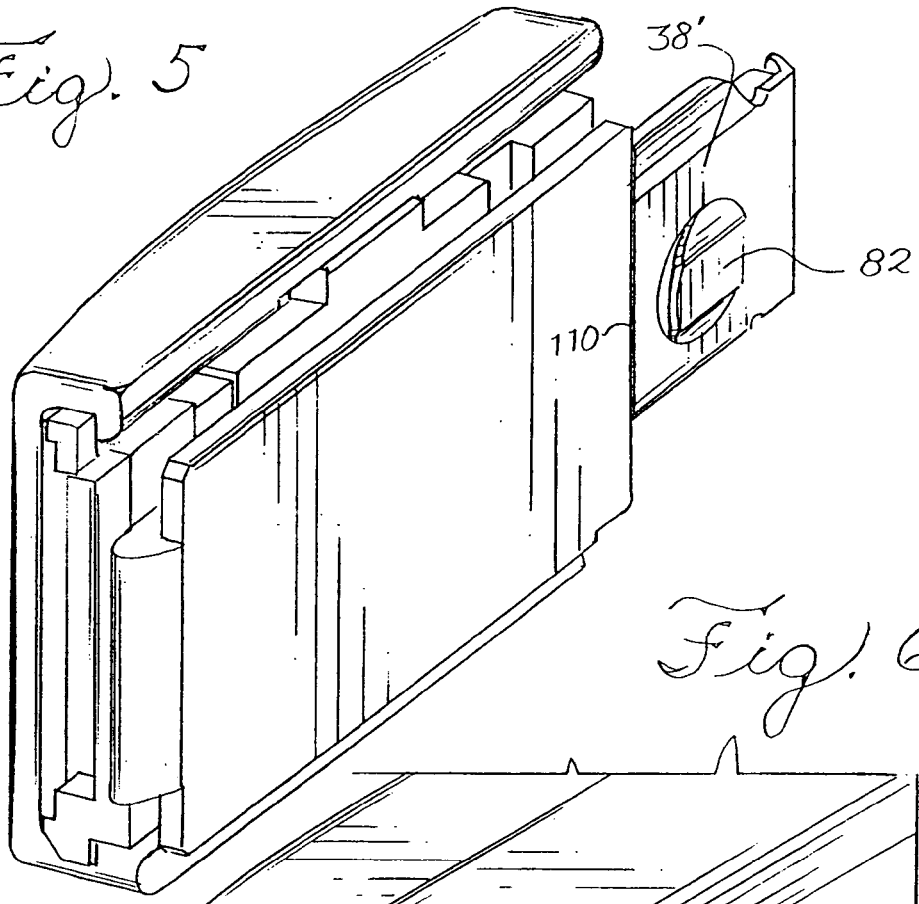
FIG. 5 depicts a back perspective view of the slide assembly device of FIG. 4.
Figure 8:
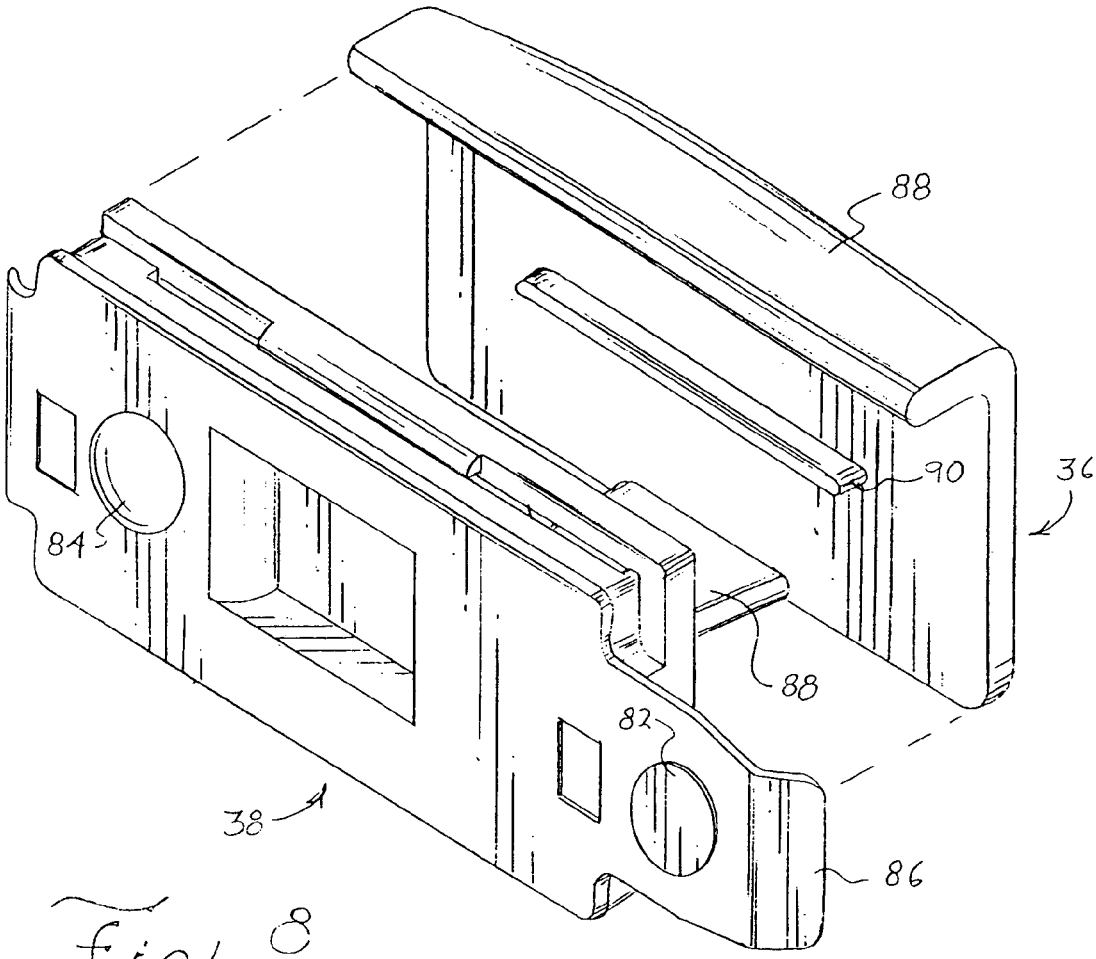
FIG. 8 depicts a back perspective view of FIG. 3 to be used with a rocker.

The slide assembly device 24 further includes a ski 38, as depicted in FIGS. 2, 3 and 8. As discussed previously, the ski 38 may contain the substantially rectangular protruded surface 80 configured to secure to the slot 52 of the housing 34, as depicted in FIGS. 2 and 3. Alternatively, a second embodiment of a ski 38' may be integrally attached to a side 110 of the housing 34, as depicted in FIG. 5. In either embodiment, the skis 38 and 38' each contains a boss 82 configured to carry a blade 28 (not shown), as depicted in FIGS. 5 and 8, by inserting the boss 82 within a hole 29 of the blade 28 (not shown). Therefore, when the slide assembly device 24 is slid to an extended or retreated position, the blade 28, which is attached to the ski 38 or 38' via the boss 82, is also slid to the extended or retreated position. The boss 82 contains a tilted surface 86, as depicted in FIGS. 2, 4 and 8, which is useful to dispatch a used blade 28 (not shown), as will be discussed later. Note that attachment between the blade 28 and the boss 82 can be reversed by having the blade 28 contain a protrusion that engages an opening in the boss 82.

Figure 9:
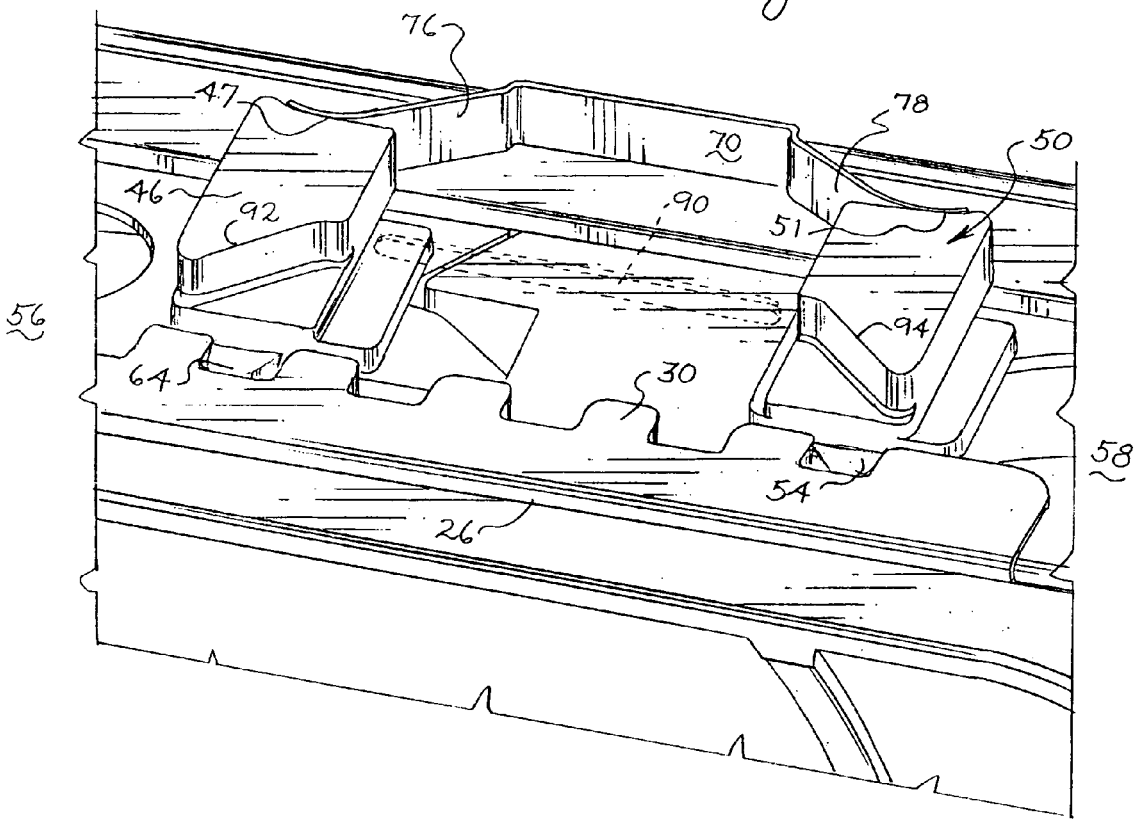
FIG. 9 depicts a perspective view of the engaging members of FIG. 4 used in the body of the utility knife of FIG. 1.
Figure 10:
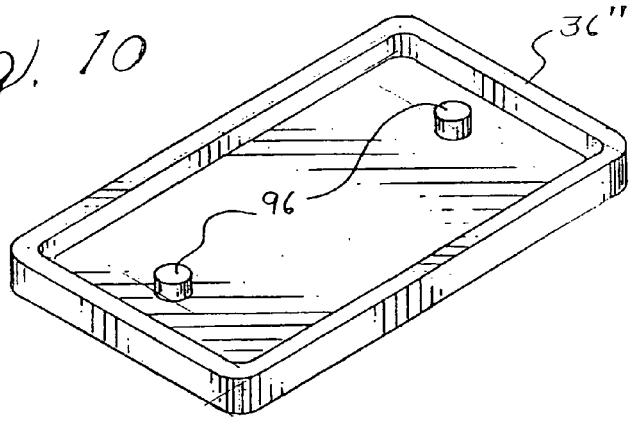
FIG. 10 depicts a back perspective view of another embodiment of a rocker to be used in the slide assembly device of FIG. 4.

The slide assembly device 24 also includes a rocker 36, as depicted in FIGS. 2 and 8. The rocker 36 is configured to be secured to the housing 34, such as by a pair of longitudinally extending hocks 88, as depicted in FIG. 8, although other methods may be used. Preferably, the rocker 36 includes an elongated member 90 that selectively faces the engaging members 46 and 50. The elongated member 90 is configured to operatively engage with a slanted track 92 of the engaging member 46 and a slanted track 94 of the engaging member 50, as depicted in FIG. 9. Alternatively, a second embodiment of the rocker 36" may include a pair of pins 96, as depicted in FIG. 10, similarly configured to operatively engage with the slanted tracks 92 and 94. Preferably, the pins 96 are cylindrical in shape, although other shapes may be used.

Figure 7B:
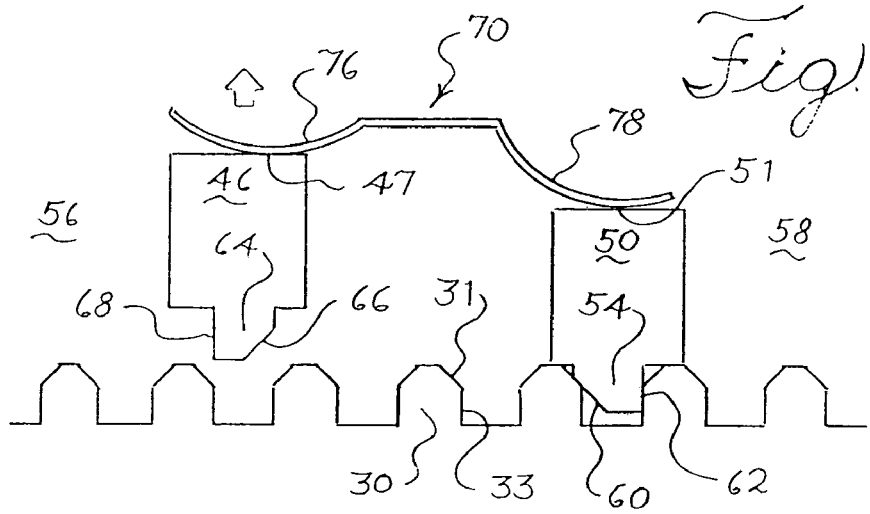
FIG. 7B depicts FIG. 7A having an engaging member disengaged.

When a user pushes on the rocker 36 towards the end 56 of the utility knife 20, the elongated member 90 of the rocker 36 that is located between the slanted track 92 of the engaging member 46 and the slanted track 94 of the engaging member 50 is pushed into and comes into contact with the slanted track 92, as depicted in FIGS. 8 and 9. As the elongated member 90 pushes along the slanted track 92, the top portion 47 of the engaging member 46 is pushed up against the extended portion 76 of the spring 70, as depicted in FIG. 7B. Simultaneously, the protrusion 64 of the engaging member 46 is shifted up and pulled away from the plurality of tabs 30 of the groove 26 and out of the spaces therebetween. The protrusion 54 of the engaging member 50, which remains engaged with a space between two tabs 30, allows the slide assembly device 24 to slide to the extended position towards the end 56 of the utility knife 20. The slide assembly device 24 is slid towards the end 56 of the utility knife 20 by virtue of the slanted side 60 of the protrusion 54 moving through the matching slanted portions 31 of the tabs 30 and produces a ratcheting sound in the process. Consequently, the blade 28, which is connected to the ski 38 of the slide assembly device 24, can also be slid to the extended position. Note that while the slide assembly device 24 can move towards end 56, the device 24 is prevent from moving to end 58 due to the engagement of the straight side 62 with the straight portion 33 of a corresponding tab 30.

A user may then discontinue pushing the rocker 36 when the blade 28 reaches a desired extended portion. Once pushing is discontinued, the remaining force, which is exerted by the extended portion 76 of the spring 70, pushes the elongated member 90 of the rocker 36 away from the slanted track 92 of the engaging member 46. Simultaneously, the extended portion 76 of the spring 70 presses down on the top portion 47 of the engaging member 46 and pushes the protrusion 64 of the engaging member 46 into a space between two consecutive the tabs 30 of the groove 26, as depicted in FIG. 7A. The straight side 68 of the protrusion 64 of the engaging member 46 will come into contact again with one of the matching straight portions 33 of the tabs 30 and prevents the slide assembly device 24 from sliding further toward the end 56. The straight side 62 of the protrusion 54 of the engaging member 50, which remains in contact with one of the matching straight portions 33 of the tabs 30, also prevents the slide assembly device 24 from sliding to the other end 58. Consequently, an extended blade 28 is fixed relative to the utility knife 20 and is ready to be used.

Figure 7C:
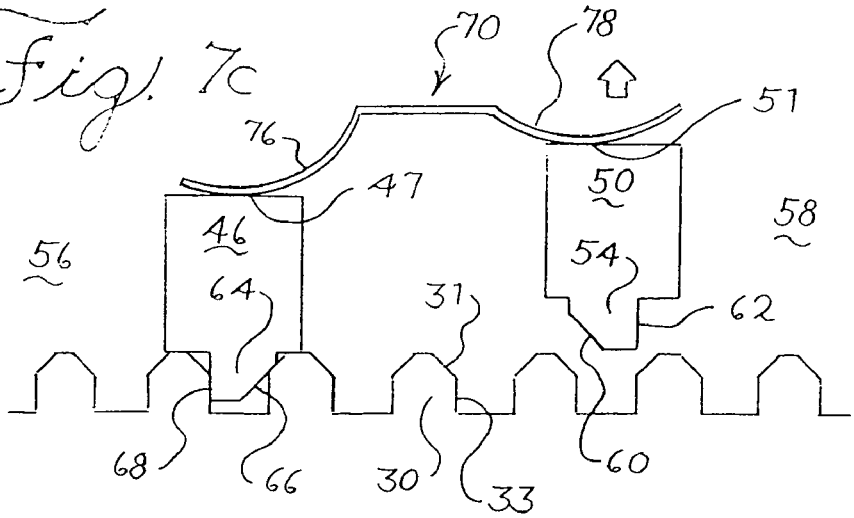
FIG. 7C depicts FIG. 7A having another engaging member disengaged.

When a user pushes on the rocker 36 towards the end 58 of the utility knife 20, the elongated member 90 of the rocker 36 that is located between the slanted track 92 of the engaging member 46 and the slanted track 94 of the engaging member 50 is pushed into and comes into contact with the slanted track 94, as depicted in FIGS. 8 and 9. As the elongated member 90 pushes along the slanted track 94, the top portion 51 of the engaging member 50 is pushed up against the extended portion 78 of the spring 70, as depicted in FIG. 7C. Simultaneously, the protrusion 54 of the engaging member 50 is shifted up and pulled away from the plurality of tabs 30 of the groove 26 and out of the spaces therebetween. The protrusion 64 of the engaging member 46, which remains engaged with a space between two tabs 30, allows the slide assembly device 24 to slide to the retreated position towards the end 58 of the utility knife 20. The slide assembly device 24 is slid towards the end 58 of the utility knife 20 by virtue of the slanted side 66 of the protrusion 64 moving through the matching slanted portions 31 of the tabs 30 and produces a ratcheting sound in the process. Consequently, the blade 28, which is connected to the ski 38 of the slide assembly device 24, can also be slid to the retreated position. Note that while the slide assembly device 24 can move towards end 58, the device 24 is prevent from moving to end 56 due to the engagement of the straight side 68 with the straight portion 33 of a corresponding tab 30.

A user may then discontinue pushing the rocker 36 when the blade 28 reaches a desired retreated portion. Once pushing is discontinued, the remaining force, which is exerted by the extended portion 78 of the spring 70, pushes the elongated member 90 of the rocker 36 away from the slanted track 94 of the engaging member 50. Simultaneously, the extended portion 78 of the spring 70 presses down on the top portion 51 of the engaging member 50 and pushes the protrusion 54 of the engaging member 50 into a space between two consecutive the tabs 30 of the groove 26, as depicted in FIG. 7A. The straight side 62 of the protrusion 54 of the engaging member 50 will come into contact again with one of the matching straight portions 33 of the tabs 30 and prevents the slide assembly device 24 from sliding further toward the end 58. The straight side 68 of the protrusion 64 of the engaging member 46, which remains in contact with one of the matching straight portions 33 of the tabs 30, also prevents the slide assembly device 24 from sliding to the other end 56. Consequently, a retreated blade 28 is fixed relative to the utility knife 20 and is ready to be stored away.

Figure 11:
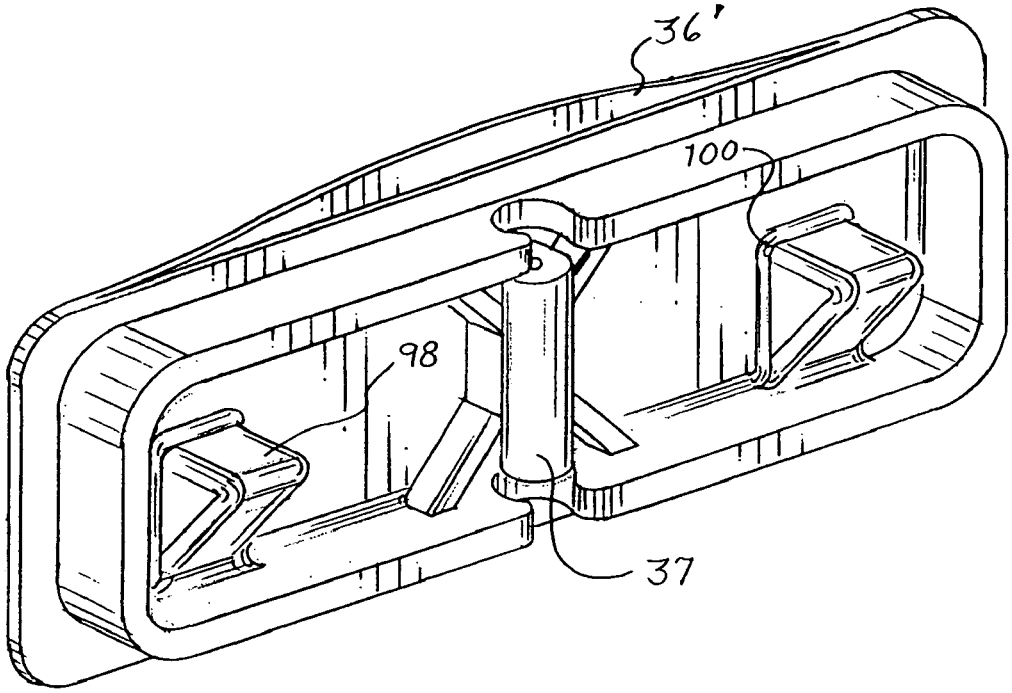
FIG. 11 depicts a back perspective view of yet another embodiment of a rocker to be used with the utility knife of FIG. 1.
Figure 12A:
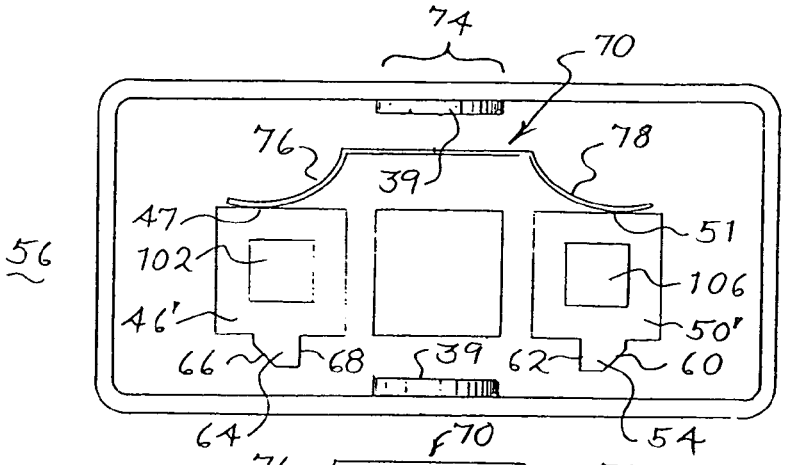
FIG. 12A depicts a front view of another embodiment of the engaging members to be used with the rocker of FIG. 11.

In an alternative, the rocker 36 and the engaging members 46 and 50 are replaced in the utility knife 20 by a third embodiment of the rocker 36' and a second embodiment of the engaging members 46' and 50', as depicted in FIGS. 11 and 12A. The rocker 36' may include an angled surface 98 and an angled surface 100, as depicted in FIG. 11. The angled surface 98 is configured to operatively engage with an opening 106 defined by the engaging member 50', as depicted in FIG. 12A. The angled surface 100 is configured to operatively engage with an opening 102 defined by the engaging member 46'. Preferably, the angled surfaces 98 and 100 are triangular-like in shape, although other shapes may be used. Preferably, the openings 102 and 106 are rectangular-like in shape, although other shapes may be used. The rocker 36' may be pivotally connected to the housing 34, for example, using a pivot 37 on the rocker 36' that engages a pair of corresponding pivot arms 39 around the central portion 74 of the housing 34, as depicted in FIGS. 11 and 12A. However, other methods may be used.

Figure 12B:
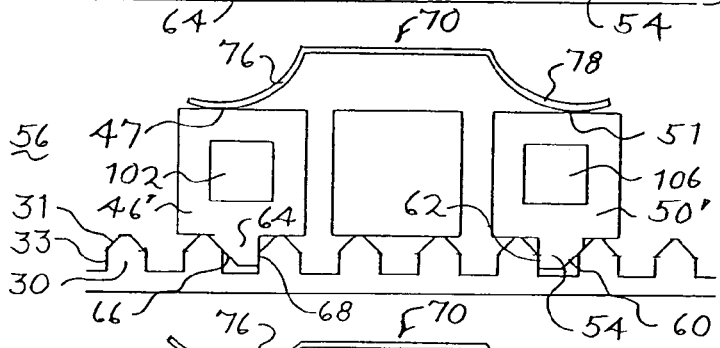
FIG. 12B depicts a partial front view the engaging members of FIG. 12A engaging with the tabs.
Figure 12C:
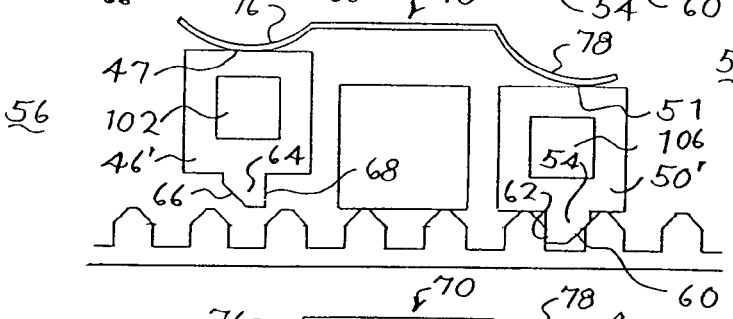
FIG. 12C depicts FIG. 12B having an engaging member disengaged.
Figure 12D:
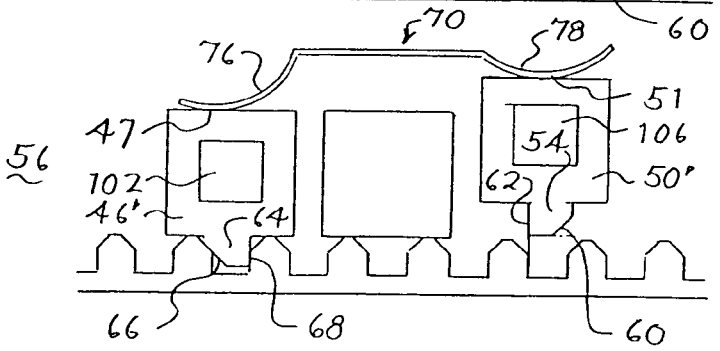
FIG. 12D depicts FIG. 12B having another engaging member disengaged.

When a user pushes the rocker 36' towards the end 56 of the utility knife 20, the angled surface 98 of the rocker 36' pivots about the pivot 37 and comes into contact with the opening 106 of the engaging member 50', as depicted in FIGS. 11 and 12A. As the angled surface 98 pivots into the opening 106, the top portion 51 of the engaging member 50' is pushed up against the extended portion 78 of the spring 70, as depicted in FIG. 12D. Simultaneously, the protrusion 54 of the engaging member 50' is shifted up and pulled away from the plurality of tabs 30 of the groove 26 and out of the space therebetwen. The protrusion 64 of the engaging member 46', which remains engaged with a space between two tabs 30, allows the slide assembly device 24 to slide to the extended position towards the end 56 of the utility knife 20. The slide assembly device 24 is slid towards the end 56 of the utility knife 20 by virtue of the slanted side 66 of the protrusion 64 moving through the matching slanted portions 31 of the tabs 30 and produces a ratcheting sound in the process. Consequently, the blade 28, which is connected to the ski 38 of the slide assembly device 24, can also be slid to the extended position. Note that while the slide assembly device 24 can move towards end 56, the device 24 is prevent from moving to end 58 due to the engagement of the straight side 68 with the straight portion 33 of a corresponding tab 30.

A user may then discontinue pushing the rocker 36' when the blade 28 reaches a desired extended portion. Once pushing is discontinued, the remaining force, which is exerted by the extended portion 78 of the spring 70, pushes the angled surface 98 pivots away from the opening 106 of the engaging member 50'. Simultaneously, the extended portion 78 of the spring 70 presses down on the top portion 51 of the engaging member 50' and pushes the protrusion 54 of the engaging member 50' into a space between two consecutive tabs 30 of the groove 26, as depicted in FIG. 12B. The straight side 62 of the protrusion 54 of the engaging member 50' will come into contact again with one of the matching straight portions 33 of the tabs 30 and prevents the slide assembly device 24 from sliding further toward the end 56. The straight side 68 of the protrusion 64 of the engaging member 46', which remains in contact with one of the matching straight portions 33 of the tabs 30, also prevents the slide assembly device 24 from sliding to the other end 58. Consequently, an extended blade 28 is fixed relative to the utility knife 20 and is ready to be used.

When a user pushes the rocker 36' towards the end 58 of the utility knife 20, the angled surface 100 of the rocker 36' pivots about the pivot 37 and comes into contact with the opening 102 of the engaging member 46', as depicted in FIGS. 11 and 12A. As the angled surface 100 is pivots into the opening 102, the top portion 47 of the engaging member 46' is pushed up against the extended portion 76 of the spring 70, as depicted in FIG. 12C. Simultaneously, the protrusion 64 of the engaging member 46' is shifted up and pulled away from the plurality of tabs 30 of the groove 26 and the space therebetween. The protrusion 54 of the engaging member 50', which remains engaged with a space between two tabs 30, allows the slide assembly device 24 to slide to the retreated position towards the end 58 of the utility knife 20. The slide assembly device is slid towards the end 58 of the utility knife 20 by virtue of the slanted side 60 of the protrusion 54 moving through the matching slanted portions 31 of the tabs 30 and produces a ratcheting sound in the process. Consequently, the blade 28, which is connected to the ski 38 of the slide assembly device 24, can also be slid to the retreated position. Note that while the slide assembly device 24 can move towards end 58, the device 24 is prevent from moving to end 56 due to the engagement of the straight side 62 with the straight portion 33 of a corresponding tab 30.

A user may then discontinue pushing the rocker 36' when the blade 28 reaches a desired retreated portion. Once pushing is discontinued, the remaining force, which is exerted by the extended portion 76 of the spring 70, pushes the angled surface 100 pivots away from the opening 102 of the engaging member 46'. Simultaneously, the extended portion 76 of the spring 70 presses down on the top portion 47 of the engaging member 46' and pushes the protrusion 64 of the engaging member 46' into a space between two consecutive tabs 30 of the groove 26, as depicted in FIG. 12B. The straight side 68 of the protrusion 64 of the engaging member 46' will come into contact again with one of the matching straight portions 33 of the tabs 30 and prevents the slide assembly device 24 from sliding further toward the end 58. The straight side 62 of the protrusion 54 of the engaging member 50', which remains in contact with one of the matching straight portions 33 of the tabs 30, also prevents the slide assembly device 24 from sliding to the other end 56. Consequently, a retreated blade 28 is fixed relative to the utility knife 20 and is ready to be stored away.

Figure 13:
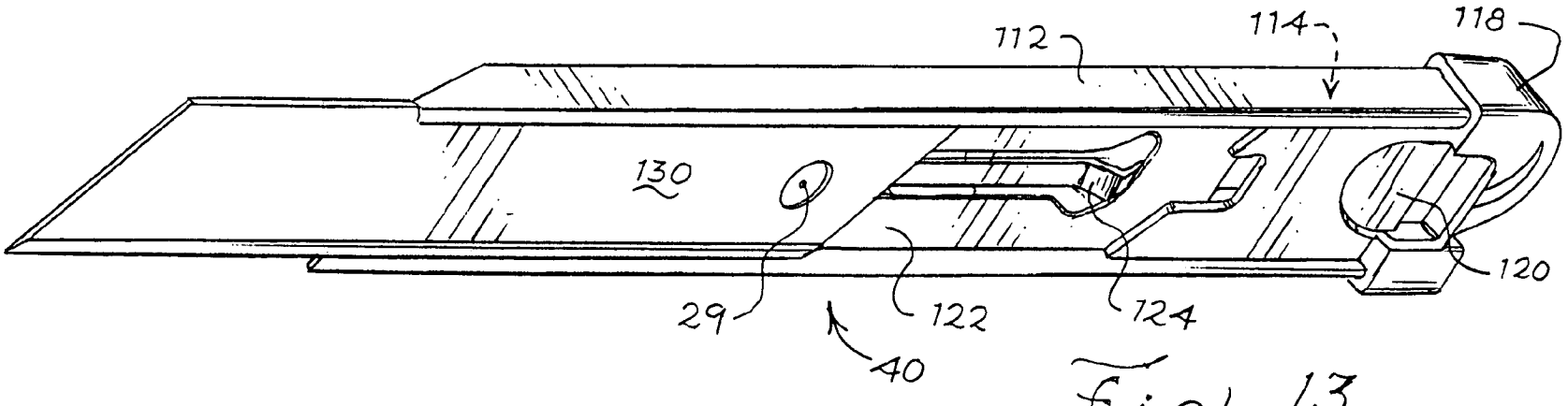
FIG. 13 depicts a front perspective view of an embodiment of a blade guide assembly to be used with the utility knife of FIG. 1 in accordance with the present invention.
Figure 15:
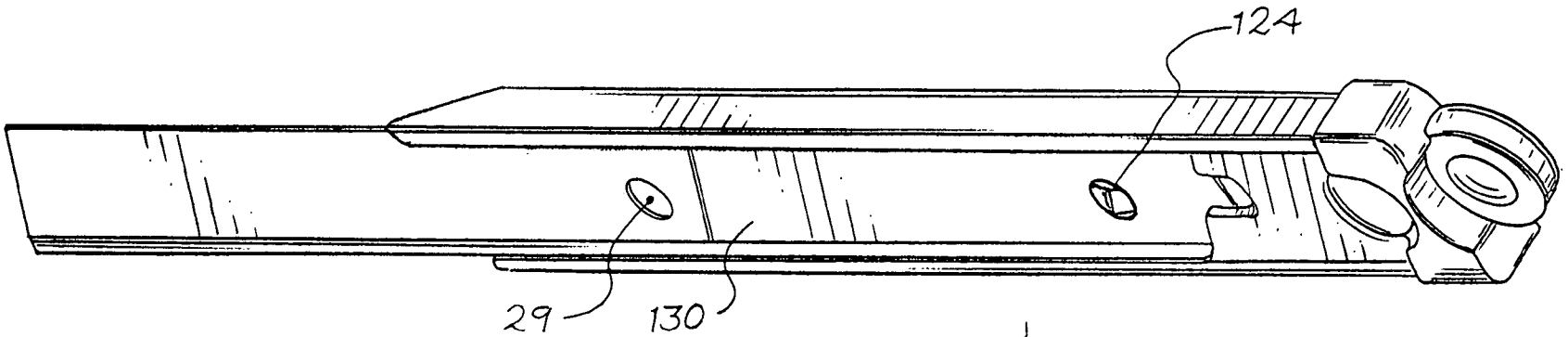
FIG. 15 depicts another front perspective view of the blade guide assembly of FIG. 13 storing multiple blades.
Figure 20:
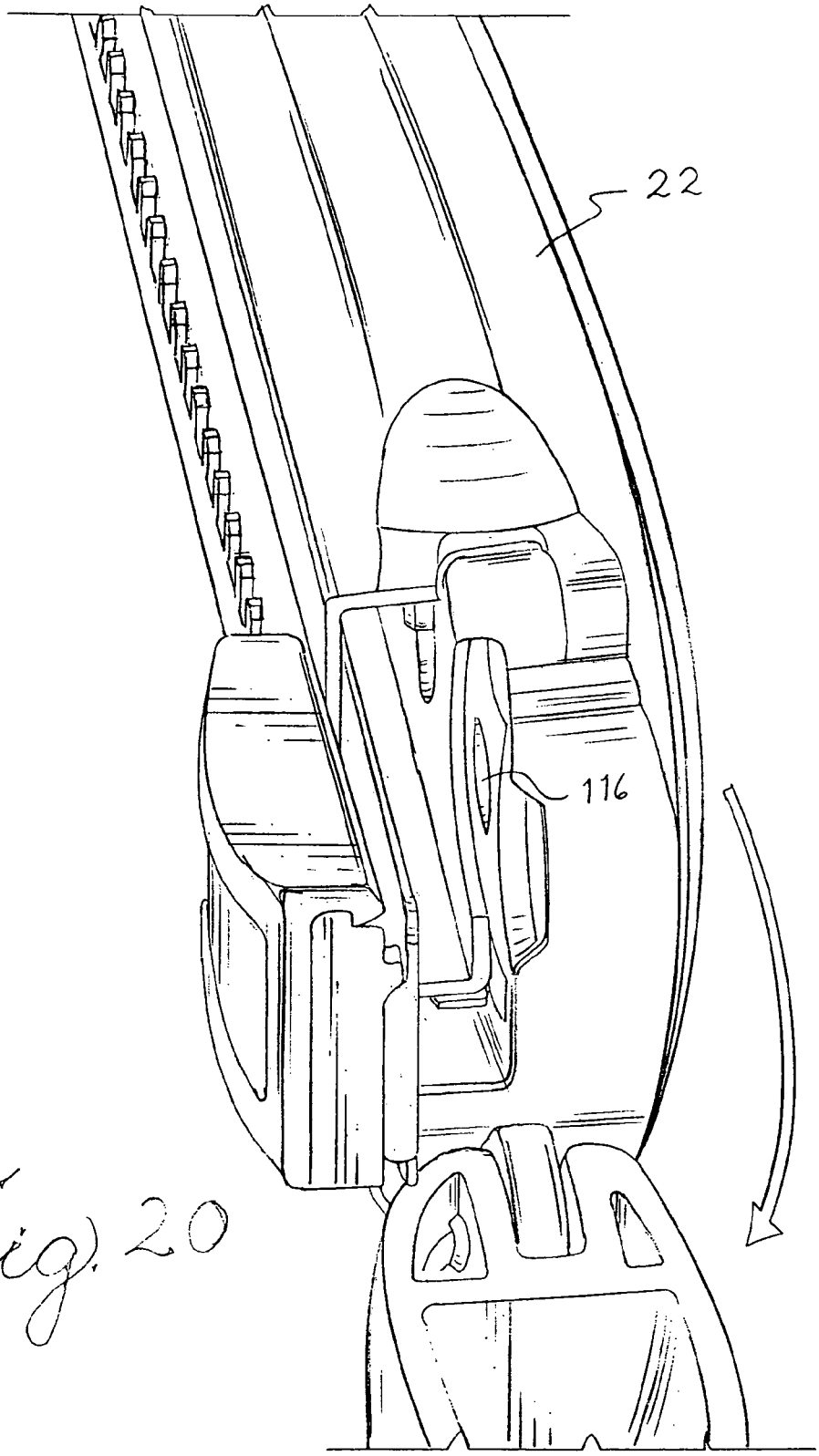
FIG. 20 depicts a rear perspective view of the utility knife of FIG. 1.

Each of the utility knives 20 described previously further includes a blade guide assembly 40, as depicted in FIGS. 13-15. The blade guide assembly 40 includes a longitudinally extending shell 112 configured to fit within the groove 26 and house the extra blades 130, as depicted in FIGS. 13 and 14. The blade guide assembly 40 also includes a handle 118 integrally attached to the longitudinally extending shell 112. The handle 118 is useful to pull the longitudinally extending shell 112 out of the groove of the body 22. As shown in FIG. 14, the handle 118 includes a snap feature 114, which is configured to operatively connect with a depression 116 of the body 22 shown in FIG. 20, by fitting the snap feature 114 into the depression 116. The back side 120 of the snap feature 114 is depicted in FIG. 13. Thus, the snap feature 114 is useful to secure the blade guide assembly 40 to the body 22.

Moreover, the blade guide assembly 40 includes a substantially flat panel 122 configured to be fitted within the longitudinally extending shell 112, as depicted in FIG. 13. The panel 122 is biased towards the blades 130 and the ski 38 (not shown) by the springs 126 and 128, as depicted in FIG. 14. The panel 122 contains a blade hole detent tang 124 configured to carry the extra blades 130 by inserting the blade hole detent tang 124 through the holes 29 of the blades 130, as depicted in FIGS. 13 and 15. Consequently, the extra blades 130 may be stored within the longitudinally extending shell 112. Preferably, the blade guide assembly 40 can store three snap-off blades 28, although any number of blades may be stored therein. Preferably, the blade hole detent tang 124 is triangular in shape, although other shapes may be used.

Figure 16:
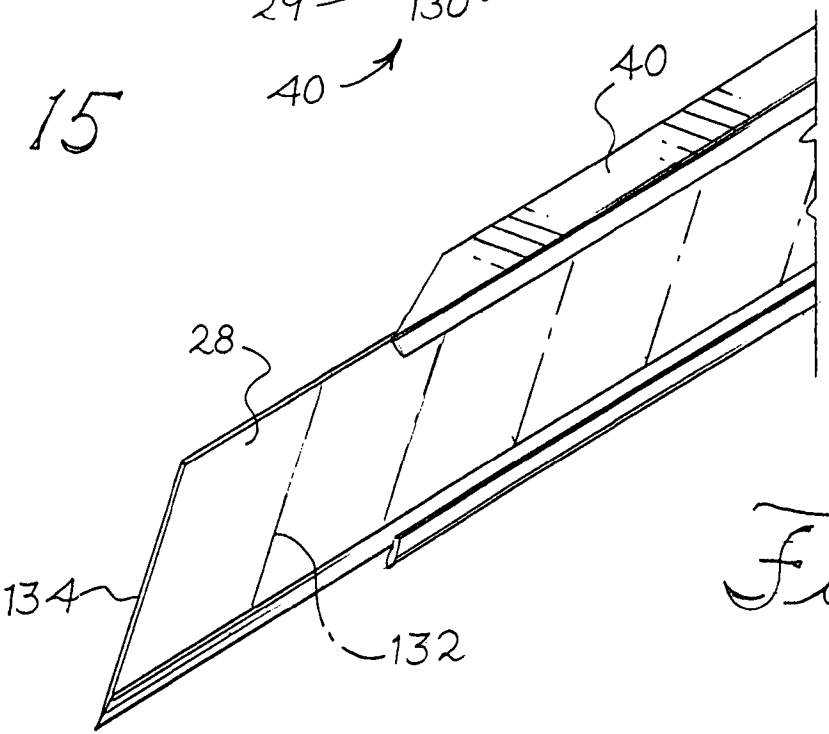
FIG. 16 depicts a partial front view of the blade guide assembly of FIG. 13 showing a series of facture lines of a snap-off blade.

When the snap-off blade 28 becomes dull, a user can break off a piece of the snap-off blade 28 along a series of fracture lines 132 to expose a new sharp edge portion 134, as depicted in FIG. 16. Moreover, when the entire snap-off blade 28 is no longer usable, a user can replace the blade 28 with one of the new blades 130 by dispatching the dull blade 28 and inserting the new sharp blade 130, which is initially stored in the blade guide assembly 40 discussed above. The new blade 130 can be inserted without dissembling the utility knife 20.

Figure 17:
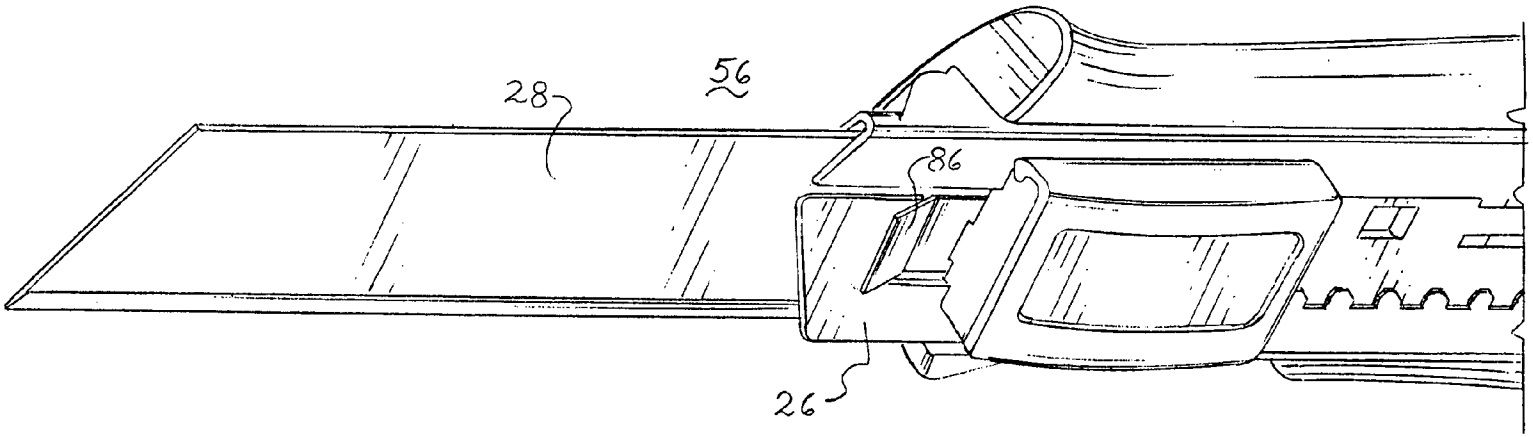
FIG. 17 depicts a partial perspective view of the utility knife of FIG. 1 with a snap-off blade extended.

To remove the existing snap-off blade 28, the slide assembly device 24 is slid towards the end 56 of the utility knife 20, in the same way discussed above. The slide assembly device 24 should be positioned such that the tilted surface 86 of the ski 38 (or 38') comes into contact with and slightly overlaps the groove 26, as depicted in FIG. 17. The overlapping of the tilted surface 86 with the groove 26 forces the boss 82 of the ski 38 (not shown) to shift slightly upward relative to the groove 26. However, even though the hole 29 of blade 28 is initially matched with the boss 82 of the ski 38, as discussed previously, the blade 28 cannot shift upward together with the boss 82 because the groove 26 constrains the vertical position of the blade 28. Therefore, the overlapping releases the hole 29 of the blade 28 from the boss 82 of the ski 38 and the blade 28 is loosened. The user can then dispatch the snap-off blade 28 from the ski 38 and subsequently from the utility knife 20.

To insert the new snap-off blade 130 to the ski 38 (or 38'), the slide assembly device 24 is slid towards the end 58 of the utility knife 20, in the same way discussed above. The slide assembly device 24 should be slid to a point where the boss 82 of the ski 38 overlaps and depresses the blade detent tang 124 of the blade guide assembly 40, as depicted in FIGS. 8 and 13. As discussed previously, the blade detent tang 124 carries the extra snap-off blades 130 within the longitudinally extending shell 112 by the holes 29 of the blades 130. Also as discussed previously, the force exerted by the springs 126 and 128 pushes the panel 122 and the new snap-off blade 130 towards the ski 38. Therefore, when the boss 82 of the ski 38 overlaps and depresses the blade detent tang 124, the springs 126 and 128 pushes the hole 29 of the new snap-off blade 130 into and matches with the boss 82 of the ski 38. This enables the boss 82 to engage with the new snap-off blade 130. When the slide assembly device 24 is slid toward the end 56 of the knife and away from the blade detent tang 124, the new blade 130 remains connected with the boss 82 of the ski 38. The utility knife 20 of the present invention thus allows a user to replace a new snap-off blade 130 without substantially dissembling and reassembling the entire utility knife 20, as commonly seen in the prior art.

Figure 18:
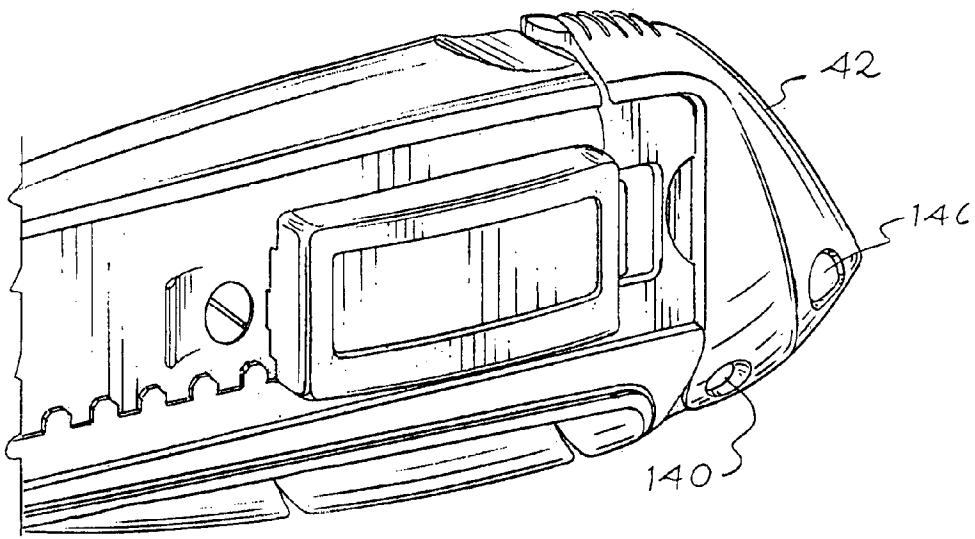
FIG. 18 depicts a partial perspective view of an embodiment of an end cap of the utility knife of FIG. 1.
Figure 19:
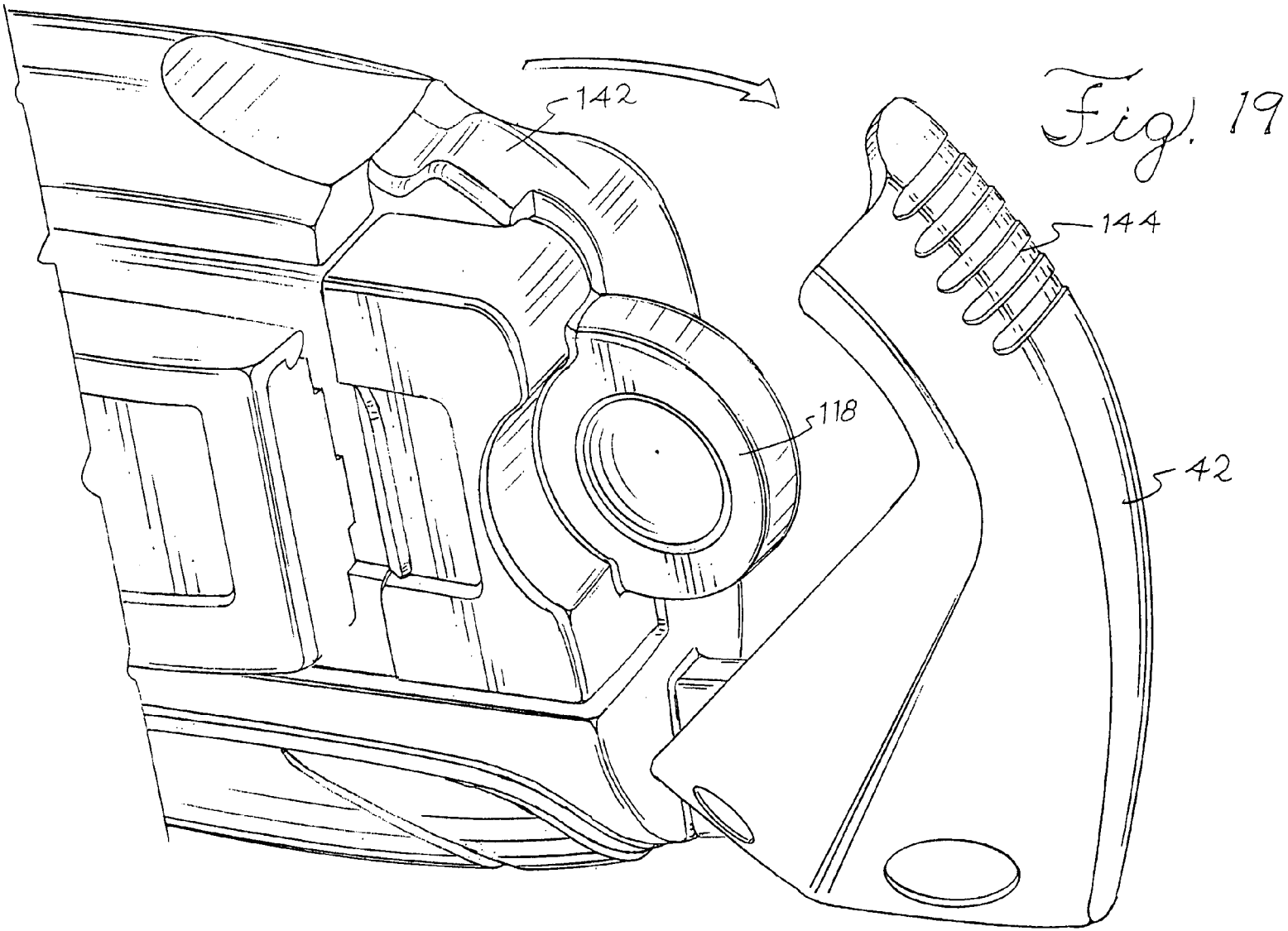
FIG. 19 depicts a close up perspective view of the end cap of FIG. 18.

Each of the utility knives 20 described previously further includes an end cap 42, as depicted in FIGS. 18 and 19. The end cap 42 is connected to the body 22 by an end cap hinge 140, as depicted in FIG. 18, although it is within the scope of the present invention to use other known methods. The end cap 42 may include an opening 146 defined therethrough to allow the user to hang the utility knife 20, for example, on a hook of a wall. The body 22 includes a snap feature 142 configured to operatively connect with the end cap 42 and thus secure the end cap 42 in a closed position, as depicted in FIG. 19. The end cap 42 further includes a finger tap 144, which allows a user to pivotally open the end cap 42. In an open position, the blade guide assembly 40 may be pulled out of the body 22 by the hand 118 as discussed above.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A utility knife comprising:

a body having a groove adapted to receive a blade, said groove having a plurality of tabs defined on at least a first side; and a slide assembly device positioned in said body for sliding movement with respect to said body, said slide assembly device comprising:

a housing comprises a first engaging member having a first protrusion and a second engaging member having a second protrusion, said first protrusion being releasably disposed between a first two of said plurality of tabs and said second protrusion being releasably disposed between a second two of said plurality of tabs; and a rocker operable for disengaging one of said first protrusion or said second protrusion from between the first two of said plurality of tabs or said second two of said plurality of tabs, respectively, without disengaging the other of said first protrusion or said second protrusion from between the first two of said plurality of tabs or said second two of said plurality of tabs, respectively, wherein disengaging said first protrusion and by said rocker allows sliding movement of said slide assembly device with respect to said body only in a first direction wherein disengaging said second protrusion by said rocker allows sliding movement of said slide assembly device with respect to said body only in a second direction opposite said first direction.

2. The utility knife of claim 1, wherein said first engaging member defines an opening.

3. The utility knife of claim 2, wherein said rocker comprises an angled surface, said angled surface configured to operatively engage with said opening.

4. The utility knife of claim 2, wherein said second engaging member defines a second opening.

5. The utility knife of claim 4, wherein said rocker comprises a second angled surface, said second angled surface configured to operatively engage with said second opening.

6. The utility knife of claim 1, wherein said first protrusion comprises a slanted side.

7. The utility knife of claim 6, wherein said rocker comprises a pin, said pin configured to operatively engage with said slanted side.

8. The utility knife of claim 6, wherein said rocker comprises an elongated member, said elongated member configured to operatively engage with said slanted side.

9. The utility knife of claim 6, wherein said second protrusion comprises a second slanted side.

10. The utility knife of claim 9, wherein said rocker comprises a second pin, said second pin configured to operatively engage with said second slanted side.

11. The utility knife of claim 1, wherein said first protrusion comprises a substantially slanted side and a straight side.

12. The utility knife of claim 11, wherein said tabs comprise a plurality of matching slanted portions configured to contact with said substantially slanted side and a plurality of matching straight portions configuration to contact with said straight side.

13. The utility knife of claim 1, wherein said second protrusion comprises a second substantially slanted side and a second straight side.

14. The utility knife of claim 13, wherein said tabs comprise a plurality of matching slanted portions configured to contact with said second substantially slanted side and a plurality of matching straight portions configuration to contact with said second straight side.

15. The utility knife of claim 1, wherein said housing comprises a first slot for receiving said first engaging member and a second slot for receiving said second engaging member.

16. The utility knife of claim 1, wherein said slide assembly device further comprises a ski having a boss configured to engage with a hole of said blade.

17. The utility knife of claim 16, wherein said housing comprises a first slot for receiving said first engaging member and a second slot for receiving said second engaging member.

18. The utility knife of claim 17, wherein said housing further comprises a third slot positioned between said first and second slots for attaching a substantially rectangular protruded surface of said ski.

19. The utility knife of claim 16, wherein said ski integrally attaches to a side of said housing.

20. The utility knife of claim 16, wherein said boss comprises a tilted surface configured to operatively engage with said groove.

21. The utility knife of claim 1, wherein said slide assembly device further comprises a spring, said spring having a substantially flat portion sandwiched near a central portion of said housing, a first extended portion that selectively contacting a top portion of said first engaging member so as to bias said first engaging member downward and a second extended portion that selectively contacting another top portion of said second engaging member so as to bias said second engaging member downward.

22. The utility knife of claim 1, further comprises an end cap pivotally connected to said body.

23. The utility knife of claim 22, wherein said body further comprises a snap feature operatively engaged with said end cap.

24. The utility knife of claim 22, wherein said end cap comprises a finger tap.

25. The utility knife of claim 22, wherein utility knife further comprises a first end closest to said end cap and a second end farthest to said end cap.

26. The utility knife of claim 1, wherein said rocker further comprises a longitudinally extending hock removably attached to said housing.

27. The utility knife of claim 1, wherein said rocker further comprises a pivot removably attached to a pair of pivot arms of said housing.

28. A utility knife comprising:

a body having a groove adapted to receive a blade, said groove having a plurality of tabs defined on at least a first side; and a slide assembly device positioned in said body for sliding movement with respect to said body, said slide assembly device comprising:

a housing comprises a first engaging member having a first protrusion and a second engaging member having a second protrusion, said first engaging member defines a first opening and said second engaging member defines a second opening, said first protrusion being releasably disposed between a first two of said plurality of tabs and said second protrusion being releasably disposed between a second two of said plurality of tabs; and a rocker comprising a first angled surface, said first angled surface configured to operatively engage with said first opening, and a second angled surface, said second angled surface configured to operatively engage with said second opening, said rocker operable for disengaging one of said first protrusion or said second protrusion from between the first two of said plurality of tabs or said second two of said plurality of tabs, respectively, without disengaging the other of said first protrusion or said second protrusion from between the first two of said plurality of tabs or said second two of said plurality of tabs, respectively, wherein disengaging one of said first protrusion and second protrusion by said rocker allows sliding movement of said slide assembly device with respect to said body.

29. A utility knife comprising:

a body having a groove adapted to receive a blade, said groove having a plurality of tabs defined on at least a first side; and a slide assembly device positioned in said body for sliding movement with respect to said body, said slide assembly device comprising a first engaging member having a first protrusion and a second engaging member having a second protrusion, said first protrusion being movable between a first position located between a first two of said plurality of tabs and a second position removed from between the first two of said plurality of tabs and said second protrusion being movable between a third position located between a second two of said plurality of tabs and a fourth position removed from between the second two of said plurality of tabs; and a rocker movable to a fifth position where said first protrusion is in said first position and said second protrusion is in said fourth position, the rocker also being movable to a sixth position where said first protrusion is in said second position and said second protrusion is in said third position, wherein when the rocker is in said fifth position said slide assembly device is able to move only toward a first end of said body, and wherein when the rocker is in said sixth position, said slide assembly is able to move only toward a second end of said body.

* * * * *